US008358314B2

(12) United States Patent
Dyke

(10) Patent No.: US 8,358,314 B2
(45) Date of Patent: Jan. 22, 2013

(54) METHOD FOR REDUCING FRAMEBUFFER MEMORY ACCESSES

(75) Inventor: Kenneth C. Dyke, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 1385 days.

(21) Appl. No.: 12/028,450

(22) Filed: Feb. 8, 2008

(65) Prior Publication Data

US 2009/0201306 A1 Aug. 13, 2009

(51) Int. Cl.
*G09G 5/36* (2006.01)

(52) U.S. Cl. ..... 345/545; 345/531; 345/592; 345/629

(58) Field of Classification Search ..... 345/531, 345/545, 592, 629
See application file for complete search history.

(56) References Cited

U.S. PATENT DOCUMENTS 5,202,672 A * 4/1993 Nakamura et al. ..... 345/467
5,463,728 A * 10/1995 Blahut et al. ..... 715/807
5,546,518 A * 8/1996 Blossom et al. ..... 345/473
5,886,708 A * 3/1999 Wakasu ..... 345/592
5,892,521 A * 4/1999 Blossom et al. ..... 345/501
5,909,219 A * 6/1999 Dye ..... 345/582
6,075,899 A * 6/2000 Yoshioka et al. ..... 382/233
6,088,018 A * 7/2000 DeLeeuw et al. ..... 345/156
6,151,030 A * 11/2000 DeLeeuw et al. ..... 345/592
6,356,314 B1 * 3/2002 Takebe ..... 348/564
6,359,631 B2 * 3/2002 DeLeeuw ..... 345/629
6,535,208 B1 3/2003 Saltchev et al.
6,573,904 B1 * 6/2003 Chun et al. ..... 345/629
6,624,816 B1 9/2003 Jones, Jr.
6,664,959 B2 12/2003 Duluk, Jr. et al.
6,819,328 B1 * 11/2004 Moriwaki et al. ..... 345/591
6,822,659 B2 * 11/2004 Marion et al. ..... 345/629
6,829,390 B2 * 12/2004 Bucher et al. ..... 382/232
7,062,087 B1 * 6/2006 Varga ..... 382/166
7,106,275 B2 9/2006 Brunner et al.
7,170,502 B2 * 1/2007 Cheng ..... 345/173
7,180,526 B2 2/2007 Dowdy
7,852,339 B2 * 12/2010 Buxton ..... 345/501
2002/0052235 A1 * 5/2002 Hirsch et al. ..... 463/31
2004/0017378 A1 * 1/2004 Lin et al. ..... 345/592
2004/0091162 A1 * 5/2004 Donahue et al. ..... 382/245
2005/0012749 A1 1/2005 Gonzalez et al.
2005/0162435 A1 * 7/2005 Hashimoto et al. ..... 345/545
2006/0007203 A1 1/2006 Chen et al.
2007/0009182 A1 * 1/2007 Yamauchi ..... 382/302
2008/0030509 A1 2/2008 Conroy et al.

* cited by examiner

*Primary Examiner* — Daniel Washburn
(74) *Attorney, Agent, or Firm* — Fletcher Yoder PC

(57) ABSTRACT

A method and electronic device employing a method of reducing memory accesses during the readout of a scanline of a frame buffer is provided, which includes reading out a series of bits on the scanline corresponding to a series of regions of pixels of the scanline, entering a default pixel value for each pixel of a region if a corresponding bit is set, and entering a pixel value obtained from accessing the scanline for each pixel of the region if the corresponding bit is not set.

27 Claims, 5 Drawing Sheets

METHOD FOR REDUCING FRAMEBUFFER MEMORY ACCESSES

BACKGROUND OF THE INVENTION

1. Field of the Invention

The present invention relates generally to displaying graphics on an electronic display screen and, more particularly, to preparing graphics for display on an electronic display screen on a computer system or portable electronic device.

2. Description of the Related Art

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

A display screen for an electronic device often displays a new frame of pixels each time the screen refreshes. Each successive frame of pixels may be stored in a portion of memory known as a framebuffer, which holds data corresponding to each pixel of the frame. A display controller generally transfers pixel data from the framebuffer to special pre-display memory registers before the pixels appear on the screen.

A framebuffer often includes a series of scanlines, each of which corresponds to a row of pixels. The electronic device generally accesses pixel data from a scanline in read bursts. Thus, depending on the number of pixels displayed on each row of the screen, the particular pixel encoding used, and the length of each read burst, each scanline may need to be accessed numerous times per screen refresh.

Additionally or alternatively, multiple layers of frames of pixels may be accumulated into a single layer for display. Each layer may employ a unique framebuffer containing pixel data encoded in a red, green, blue, alpha (RGBA) color space, providing both color information and a level of transparency for each pixel. In certain applications, such as video playback, a topmost layer may contain a small number of visible pixels for displaying video status and a large number of transparent pixels, while a layer beneath the topmost layer may contain the video for playback. The topmost layer may remain largely unchanged from one frame to the next, and most scanlines of the framebuffer holding each frame may contain exclusively transparent pixels. However, the electronic device may still access each scanline numerous times to obtain the same pixels. During each scanline access, the device consumes a small amount of processing resources, memory resources, and power.

As the demand for smaller portable electronic devices with wide ranges of functionality increases, processing and memory resources, as well as power efficiency, may become increasingly valuable. For applications such as the playback of a movie, the amount of system resources consumed by repeatedly accessing a scanline of a framebuffer may be substantial. Moreover, though certain techniques, such as run length encoding, may mitigate some excess data transfer, such techniques may unnecessarily require additional processing and/or may not operate as efficiently as desired.

SUMMARY

Certain aspects of embodiments disclosed herein by way of example are summarized below. It should be understood that these aspects are presented merely to provide the reader with a brief summary of certain forms an invention disclosed and/or claimed herein might take and that these aspects are not intended to limit the scope of any invention disclosed and/or claimed herein. Indeed, any invention disclosed and/or claimed herein may encompass a variety of aspects that may not be set forth below.

An electronic device is provided having circuitry configured to reduce memory accesses to a scanline when preparing a frame of pixel data for display. In accordance with an embodiment of the invention, the electronic device includes a display, memory circuitry having a framebuffer with a plurality of scanlines, and display control circuitry coupled to the memory circuitry and the display. Each of the plurality of scanlines may include a series of additional bits, each of which corresponds respectively to a region of the scanline. The display control circuitry is configured to prepare pixels for display on the display by accessing pixels from a region of a scanline if a bit corresponding to the region is not set, and by setting pixels to a preset value without accessing the region if the bit corresponding to the region is set. The electronic device may include, for example, a notebook or desktop computer, a portable media player, a portable telephone, or a personal digital assistant.

A technique is also provided for reducing memory accesses to a framebuffer when preparing a frame of data for display. In accordance with an embodiment of the invention, a method of reading a scanline of a framebuffer includes reading a series of bits from memory, each bit of the series of bits corresponding to a respective region of pixels in a scanline of a framebuffer. The method also includes obtaining a stored pixel value for each pixel of a respective region of the scanline by accessing the respective region if a bit corresponding to the particular region is not set, and obtaining a predetermined pixel value for all pixels of the respective region without accessing the respective region if the bit corresponding to the respective region is set. If the bit corresponding to the respective region is not set, obtaining the stored pixel value for each pixel of the respective region of the scanline may also include setting the bit corresponding to the respective region if all pixel values for the pixels of the respective region are of the predetermined pixel value.

BRIEF DESCRIPTION OF THE DRAWINGS

These and other features, aspects, and advantages of the present invention will become better understood when the following detailed description of certain exemplary embodiments is read with reference to the accompanying drawings in which like characters represent like parts throughout the drawings, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
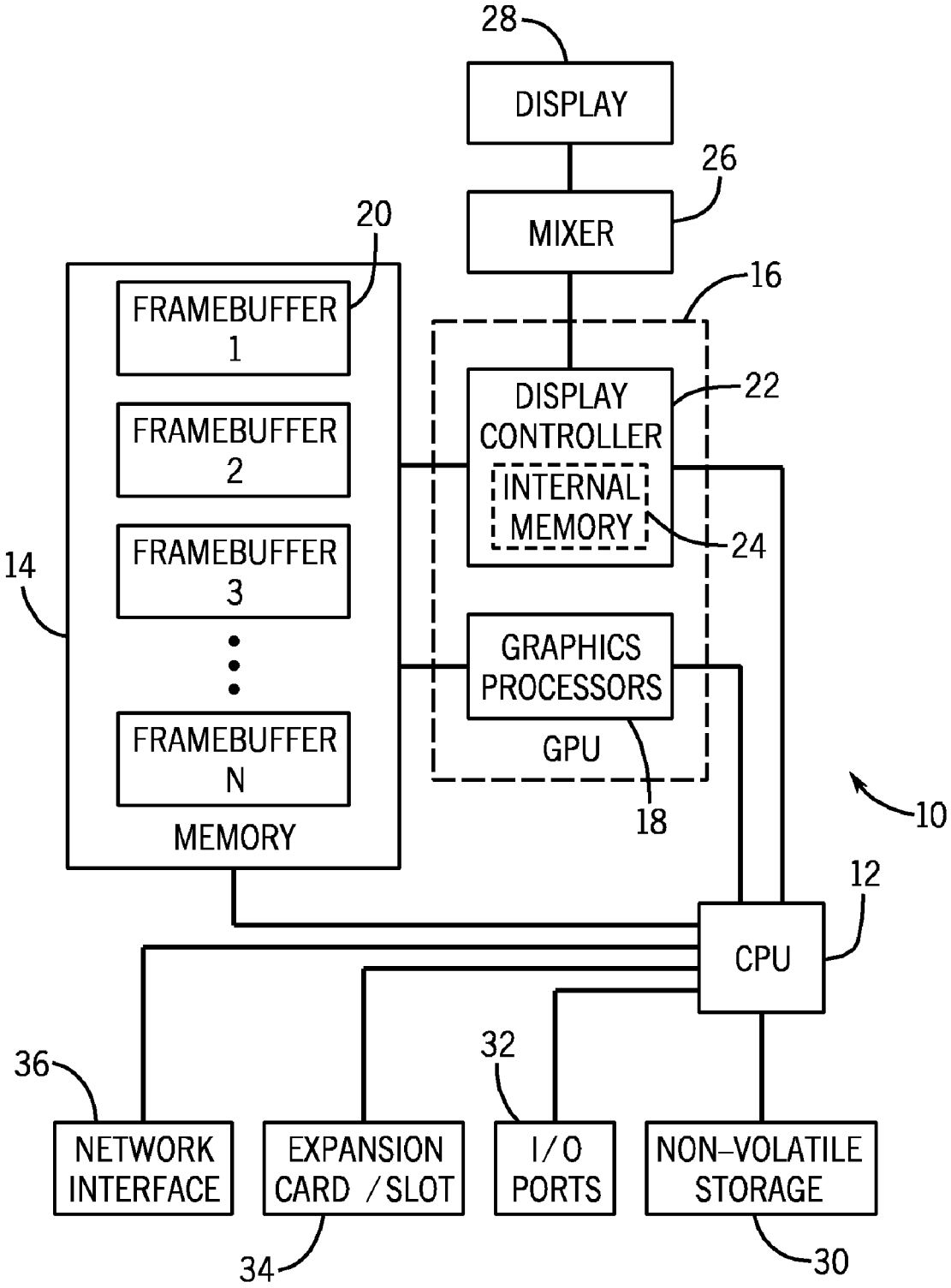
FIG. 1 is a simplified block diagram of an electronic device configured in accordance with one embodiment of the present invention.

Turning to the figures, FIG. 1 illustrates an electronic device 10 in accordance with one embodiment. The electronic device 10 may be a computer system, such as a desktop computer system, notebook computer system, or any other variation of computer system. Further, the electronic device 10 may be a portable device, such as a portable media player or a portable telephone. For example, the electronic device 10 may be a model of an iPod® having a display screen or an iPhone® available from Apple Inc.

The electronic device 10 may include one or more central processing units (CPUs) 12. The CPU 12 may include one or more microprocessors, such as one or more "general-purpose" microprocessors, a combination of general and special purpose microprocessors, and/or ASICS. For example, the CPU 12 may include one or more reduced instruction set (RISC) processors, such as a RISC processor manufactured by Samsung, as well as graphics processors, video processors, and/or related chip sets. The CPU 12 may provide the processing capability to execute an operating system, programs, user interface, graphics processing, and/or other desired functions.

A memory 14 and a graphics processing unit 16 communicate with the CPU 12. The memory 14 generally includes volatile memory such as any form of RAM, but may also include non-volatile memory, such as ROM or Flash memory. In addition to buffering and/or caching for the operation of the electronic device 10, the memory 14 may also store firmware and/or any other programs or executable code needed for the electronic device 10.

The graphics processing unit (GPU) 16 may include one or more graphics processors 18, which may perform a variety of hardware graphics processing operations, such as video and image decoding, anti-aliasing, vertex and pixel shading, scaling, rotating, and/or rendering a frame of graphics data into memory. The CPU 12 may provide basic frame data from which the graphics processors 18 may successively complete all graphics processing steps, or the CPU 12 may intervene between steps to transfer frame data from one of the graphics processors 18 to another. Additionally or alternatively, the CPU 12 may provide graphics processing in software.

When either the graphics processors 18 or the CPU 12 complete graphics processing for a frame of graphics, the processed frame data is written into one of the appropriate framebuffers 20 within the memory 14. A framebuffer is an area of memory reserved for the storage of frame data, and framebuffers 20 may alternatively be located in a different memory, such as dedicated video memory within the GPU 16. A total number N of framebuffers 20 within the memory 14 generally corresponds to a number of layers, 1 through N, of frame data. For example, the electronic device 10 may have a capability to process three graphics layers, a video layer, and a background layer, in which case at least five framebuffers 20 would likely be reserved in the memory 14. The number of framebuffers 20 may correspondingly increase if graphics are double- or triple-buffered to enhance performance. For example, the electronic device 10 may include five layers and may triple-buffer the graphics, and the memory 14 may thus hold as many as fifteen framebuffers.

Frame data held by each of the framebuffers 20 may generally include many rows, or scanlines, of pixels encoded in an RGB or RGBA color space. RGB color space encoding provides a pixel value determined by a combination of values of red, green, and blue. In contrast, RGBA color space encoding provides a pixel value determined by a combination of values of red, green, blue, and an alpha value, which encodes an opacity value for the pixel. Generally, the alpha value in the RGBA color space encodes the opacity of the pixel from 0% (transparent) to 100% (opaque). In an embodiment employing multiple layers, alpha values in the RGBA color space determine whether and how much a lower layer may be visible through an upper layer.

A display controller 22 of FIG. 1 reads pixel data from one of the framebuffers 20 and prepares the data for viewing. In accordance with an embodiment of the present technique, the display controller 22 may first read a series of bits associated with the framebuffer into internal memory 24. Generally, the display controller 22 accesses data held by one of framebuffers 20 in read bursts, but depending on whether a bit of the series of bits is set or not set, the display controller 22 may forego accessing the framebuffer during a given read burst, in accordance with embodiments of the present invention. For example, if a bit is not set, the display controller 22 may access the framebuffer to obtain a full read burst length of pixel data, entering the data into a first-in-first-out (FIFO) buffer in the display controller for transfer to a mixer 26. However, if a bit is set, the display controller 22 may instead send to the FIFO buffer a read burst length of pixel data in which each pixel has a preset, or default, value.

From the display controller 22, frame data from the framebuffers 20 subsequently may pass to the mixer 26, which assembles a final visible frame for display on a display 28. If pixels among the frame data are encoded in the RGBA color space, the alpha value for each pixel determines the opacity of the pixel. Thus, the mixer 26 may assemble a final visible frame by first adding pixel data from a topmost layer, gradually filling in each pixel with pixel data from lower layers until the combined alpha values for each pixel of the final frame reach 100% opacity. The process employed by the mixer 26 to assemble the final visible frame for display may be referred to as "alpha compositing."

Receiving the final visible frame from the mixer 26, the display 28 displays the pixels of the frame. Capable of displaying a number of rows, each row holding a number of pixels, the display 28 may be any suitable display, such as a liquid crystal display (LCD), a light emitting diode (LED) based display, an organic light emitting diode (OLED) based display, a cathode ray tube (CRT) display, or an analog or digital television. Additionally, the display 28 may also function as a touch screen through which a user may interface with the electronic device 10.

The electronic device 10 of FIG. 1 may further include non-volatile storage 30, input/output (I/O) ports 32, one or more expansion slots and/or expansion cards 34, and a network interface 36. The non-volatile storage 30 may include any suitable non-volatile storage medium, such as a hard disk drive or Flash memory. Because of its non-volatile nature, the non-volatile storage 30 may be well suited to store data files such as media (e.g., music and video files), software (e.g., for implementing functions on the electronic device 10), preference information (e.g., media playback preferences), lifestyle information (e.g., food preferences), exercise information (e.g., information obtained by exercise monitoring equipment), transaction information (e.g., information such as credit card information), wireless connection information (e.g., information that may enable media device to establish a wireless connection such as a telephone connection), subscription information (e.g., information that maintains a record of podcasts or television shows or other media a user subscribes to), as well as telephone information (e.g., telephone numbers).

The expansion slots and/or expansion cards 34 may expand the functionality of the electronic device 10, providing, for example, additional memory, I/O functionality, or networking capability. By way of example, the expansion slots and/or expansion cards 34 may include a Flash memory card, such as a Secure Digital (SD) card, mini- or microSD, CompactFlash card, or Multimedia card (MMC). Additionally or alternatively, the expansion slots and/or expansion cards 34 may include a Subscriber Identity Module (SIM) card, for use with an embodiment of the electronic device 10 with mobile phone capability.

To enhance connectivity, the electronic device 10 may employ one or more network interfaces 36, such as a network interface card (NIC) or a network controller. For example, the one or more network interfaces 36 may be a wireless NIC for providing wireless access to an 802.11x wireless network or to any wireless network operating according to a suitable standard. The one or more network interfaces 36 may permit electronic device 10 to communicate with other electronic devices utilizing an accessible network, such as handheld, notebook, or desktop computers, or networked printers.

Figure 2:
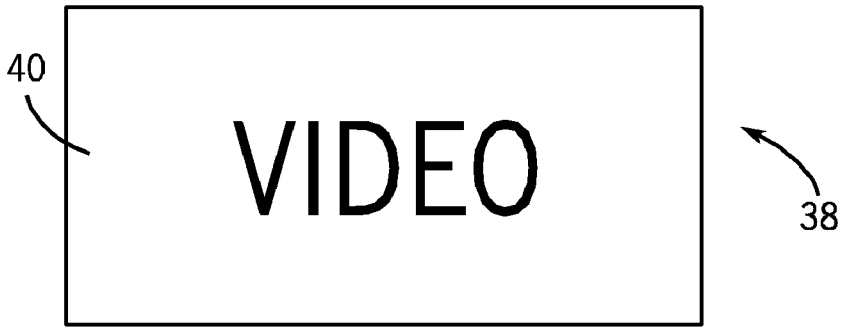
FIG. 2 is a simplified illustration of a frame of a video layer employed by the electronic device of FIG. 1 in accordance with one embodiment of the present invention.

FIG. 2 depicts a frame 38 of pixel data for a video layer, which may be stored in one of the framebuffers 20. Though the frame 38 of FIG. 2 illustrates a video image 40 from a video layer, the frame 38 may alternatively correspond to any layer not a topmost layer, such as a lower graphics layer or background layer.

Figure 3:
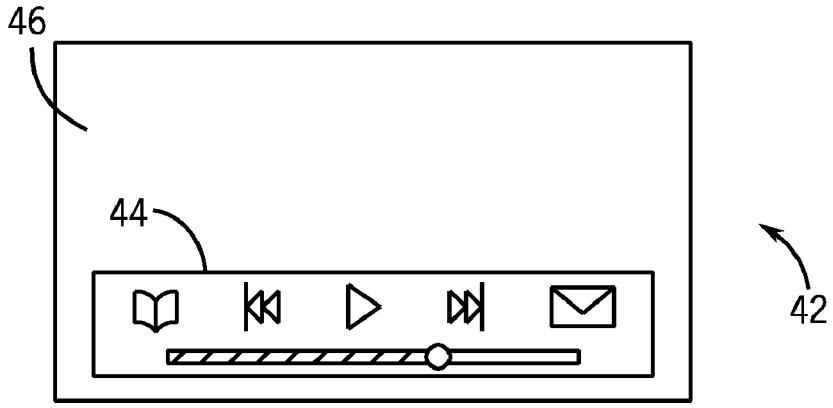
FIG. 3 is a simplified illustration of a frame of a graphics layer employed by the electronic device of FIG. 1 in accordance with one embodiment of the present invention.

FIG. 3 depicts a frame 42 of pixel data for a graphics layer above the video layer of the frame 38, which may be stored in another of the framebuffers 20. The frame 42 of FIG. 3 illustrates a topmost graphics layer providing a video playback interface 44 and transparent pixels 46, but may alternatively correspond to any layer of any type located above the frame 38. The video playback interface 44 may provide a video control interface for a user and a variety of video status information, and may remain fully visible for the duration of video playback or may become fully or partially transparent after a brief period of non-use. The transparent pixels 46 have alpha values of 0% opacity to permit the video layer to be seen behind the video playback interface 44 when the mixer 26 assembles a final visible frame.

Figure 4:
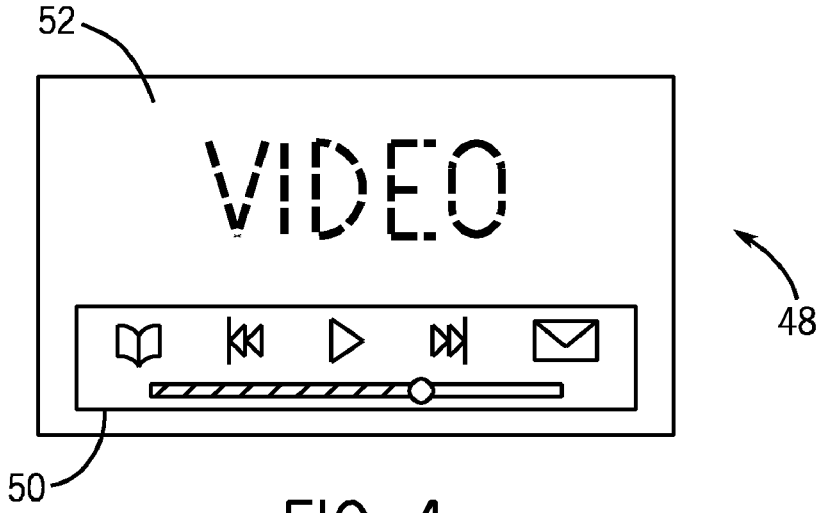
FIG. 4 is a simplified illustration of a frame combining the video layer of FIG. 2 with the graphics layer of FIG. 3 for display on the electronic device of FIG. 1 in accordance with an embodiment of the present invention.

Turning to FIG. 4, the frame 48 represents a final visible frame resulting when the mixer 26 uses alpha compositing to combine the frames 38 and 42 using data obtained from their respective framebuffers 20. Because the frame 42 represents the topmost layer, the video playback interface 44 appears as a fully visible video playback interface 50 in the frame 48 and a corresponding portion of the video image 40 remains fully hidden behind it. However, the area of the transparent pixels 46 from the topmost frame 42 allows a visible video image 52 to appear in the frame 48 when the mixer 26 combines the lower frame 38 with the topmost frame 42 during alpha compositing.

Figure 5:
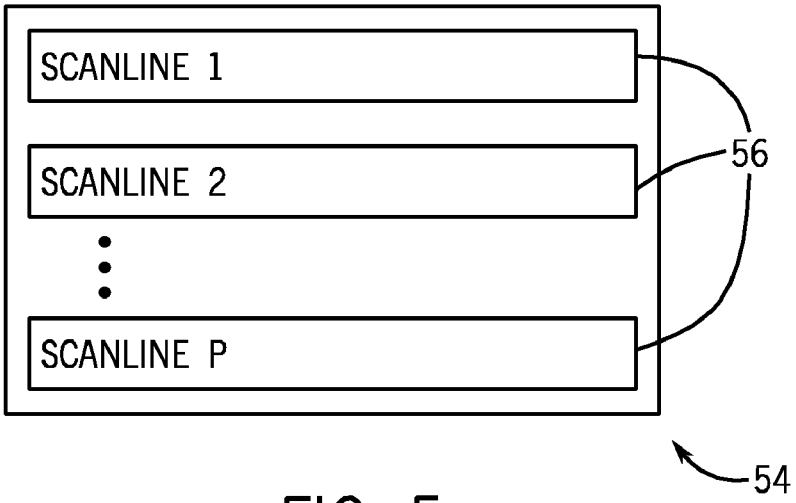
FIG. 5 is a simplified block diagram depicting a framebuffer for use in the electronic device of FIG. 1 in accordance with an embodiment of the present invention.

FIG. 5 depicts a block diagram of a framebuffer 54, representing one of the framebuffers 20 in the memory 14. The framebuffer 54 includes a plurality of the scanlines 56. Numbered 1 through P, each of the plurality of scanlines 56 represents a row of pixels in a frame having a total of P rows.

Figure 6:
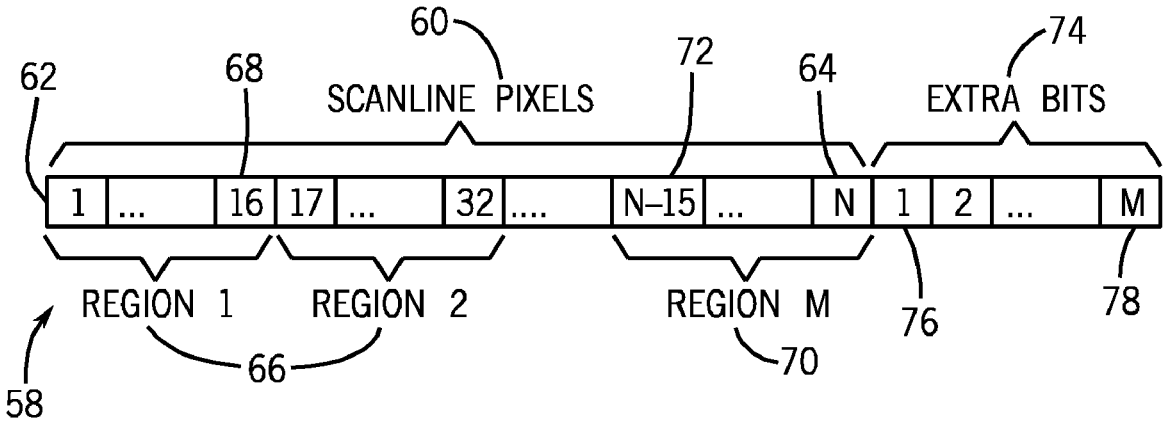
FIG. 6 is a simplified block diagram depicting an arrangement of regions of pixels in a scanline of the framebuffer of FIG. 5 for use in the electronic device of FIG. 1 in accordance with an embodiment of the present invention.

In FIG. 6, a block diagram of a scanline 58 illustrates one embodiment of one of the plurality of scanlines 56. The scanline 58 includes a series of the scanline pixels 60 of N total pixels, where N represents a number of pixels for display in a row on the display 28. Each pixel may occupy an amount of memory sufficient to encode pixel data, depending on a desired pixel encoding scheme. For example, if pixel encoding for an RGBA color space is desired, each pixel may occupy 32 bits of memory. Beginning with a first pixel 62, numbered "1," the scanline pixels 60 may continue serially until reaching a final pixel 64, numbered "N."

The scanline pixels 60 may be further conceptually divided into a plurality of regions 66, each having an equal number of pixels. Generally, the regions 66 may be defined in any manner based on efficient pixel data access by the display controller 22. For example, since the display controller 22 generally may access memory in discrete read bursts, the regions 66 may hold an amount of pixel data equivalent to the size of a read burst. In the embodiment illustrated by the scanline 58, the size of the regions 66 is chosen to correspond to a read burst length. Thus, an embodiment employing a read burst length of sixteen 32-bit words would employ regions 66 holding sixteen RGBA-encoded pixels and, accordingly, a first region of the regions 66 would begin with the first pixel 62 and continue serially to a sixteenth pixel 68. The scanline 58 may hold a total of M regions, where M represents a number of regions into which the scanline pixels 60 may be divided. A final region 70, labeled "Region M," begins with a first pixel 72, numbered "N-15," and ends with the final pixel 64, numbered "N."

Continuing to refer to FIG. 6, a series of extra bits 74 is illustrated after the final pixel 64 of the scanline pixels 60. The series of extra bits 74 total at least as many bits as regions, but additional bits may precede or follow the series of extra bits 74. Alternatively, the series of extra bits 74 may appear at the beginning of the scanline 58 or may be located in a different memory location altogether. Beginning with a first bit 76, numbered "1," and ending with a final bit 78, numbered "M," each bit of the series of extra bits 74 corresponds to one of the regions 66. For example, first bit 76 corresponds to a first of the regions 66, and final bit 78 corresponds to the final region 70. As to be described further below, the series of extra bits 74 may be employed to reduce accesses to the framebuffer 54 while obtaining the data contained therein.

Figure 7:
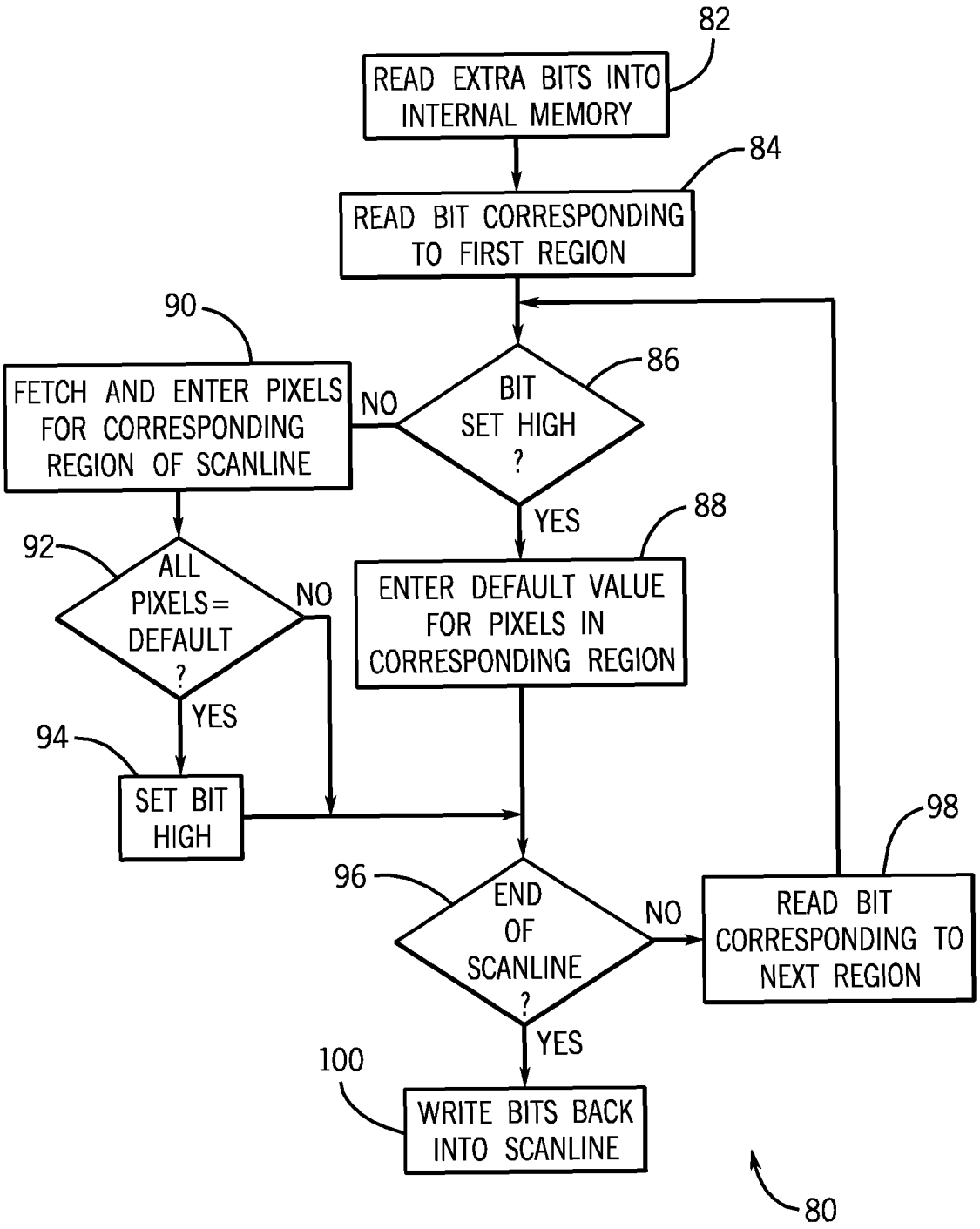
FIG. 7 is a flowchart depicting a method of reading a scanline of a framebuffer in accordance with an embodiment of the present invention.

FIG. 7 depicts a flowchart 80 illustrating a method of reducing memory accesses to a scanline of a framebuffer 54 while collecting data stored in the scanline. Beginning with a step 82, the display controller 22 may initiate the collection of pixel data from the framebuffer 54 by first reading the series of extra bits 74 into the internal memory 24. In a subsequent step 84, the display controller 22 may analyze the first bit 76 of the series of extra bits 74. As discussed above, each of the bits of the series of extra bits 74 corresponds to one of the regions 66 of the scanline pixels 60 in the scanline 58. In accordance with a decision block 86, if the bit is set high, then the process flows to a step 88 and the display controller 22 does not fetch pixel data from the first of the regions 66. Instead, the display controller 22 may enter a set of default pixel data into FIFO buffers, which may subsequently pass the data to the mixer 26.

As illustrated by the decision block 86 and the step 88, a bit from the series of extra bits 74 indicates that pixel data in the corresponding region is of a default pixel value. The default pixel value of the corresponding region may indicate that all pixels are of the same value as a default pixel value, or that all pixels share a particular default characteristic, such as a default alpha value. Alternatively, the default pixel value may indicate that the pixels of the corresponding region occur in a particular default pattern. The default pixel value may be predetermined depending on a particular application, and thus does not require derivation through complex run length encoding.

By way of example, the method described by the flowchart 80 may be applied to collecting pixel data from the scanline 58 of a framebuffer 54 holding pixel data from the frame 42 of FIG. 3. Because the frame 42 contains large areas in which scanlines may hold only transparent pixels 46, pixels stored in a particular one of the regions 66 of a scanline 58 may all share an alpha value of 0% opacity. Thus, in anticipation of such a commonality among all pixels in the region, an alpha value of 0% opacity may be predetermined to be the default pixel value. When a bit corresponding to a given region is set high and the decision block 86 indicates moving the process to the step 88, the display controller 22 may enter a set of pixel data in which each pixel has an alpha value of 0% into FIFO buffers.

In contrast, if the bit is not set high, the decision block 86 provides that display controller 22 does fetch pixels from the corresponding region of the scanline 58, in accordance with a step 90. After fetching the pixels, the display controller 22 may test whether the region of pixels matches the predetermined default pixel value, as indicated by a decision block 92. If the region of pixels matches the predetermined default value, then the process flows to a step 94. In the step 94, the display controller 22 may set the bit corresponding to the region of fetched pixels to high. Accordingly, when the display controller 22 seeks to obtain pixels from the same region 66 of the scanline 58 in future reads of the scanline 58, the corresponding bit set high in the series of extra bits 74 will indicate that, in accordance with the decision block 86 and the step 88, the display controller 22 need not fetch the pixels from the region 66 of the scanline 58, but may instead enter the default pixel data. After the step 94, the process flows to a decision block 96. If, as indicated by the decision block 92, the fetched region of pixels does not match the predetermined value, the process skips step 94 and flows directly to the decision block 96.

Continuing to view the flowchart 80 of FIG. 7, in the decision block 96, the display controller 22 may determine whether it has reached the end of the scanline pixels 60 of the scanline 58. If the display controller 22 has not yet reached the final region 70 of the scanline 58, the process flows to a step 98. As before, the display controller 22 reads the bit from the series of extra bits 74 stored in the internal memory 24 corresponding to the next region of pixels, prior to analyzing in the decision block 86 whether the bit is set high. In this way, the display controller 22 only fetches pixels from one of the regions 66 of the scanline 58 if the pixels of the region are not of the default pixel value.

When the display controller 22 has reached the end of the scanline 58 at the decision block 96, the process flows to a step 100. In the step 100, the display controller 22 writes the series of extra bits 74 currently located in the internal memory 24 back into the scanline 58. Accordingly, any bits set high during the step 94 may be used in future reads of the scanline 58 to indicate that the display controller 22 need not again access the corresponding region of the scanline 58.

Figure 8:
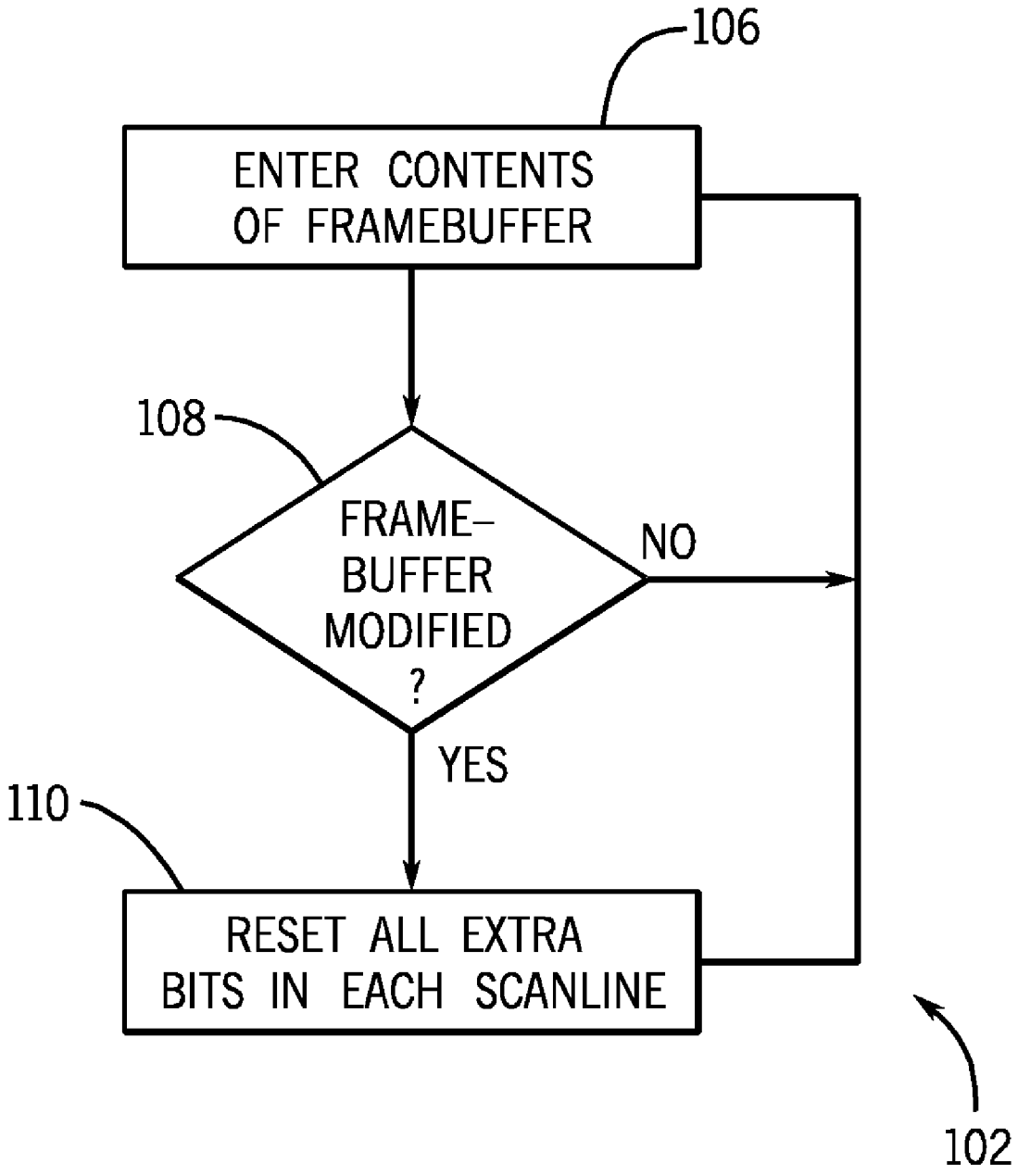
FIG. 8 is a flowchart depicting a method of displaying the contents of a framebuffer in accordance with an embodiment of the present invention.

Turning to FIG. 8, flowchart 102 illustrates a method for use when data in one of the framebuffers 20 is modified. Subsequent frames of data for a given layer stored in one or more of the framebuffers 20 may be different, as in the case, for example, of a video layer providing a series of video frames which continuously change to produce moving images. However, subsequent frames for another layer may instead change much less frequently. When a subsequent frame for a given layer remains unchanged from a prior frame, the series of extra bits 74 for a given scanline 58 of the subsequent frame remain accurate indicators of which of the regions 66 hold pixels of the default pixel value for future scanline reads. However, when a subsequent frame is modified from a prior frame, unless each of the regions 66 is tested to determine whether the pixels are of the default pixel value, the series of extra bits 74 for a given scanline 58 of the subsequent frame may not remain accurate.

Beginning with a step 106, the flowchart 102 provides that the display controller 22 first enters the contents of at least one of the framebuffers 20. Generally, the display controller 22 may enter the entire contents of one of the framebuffers 20 scanline-by-scanline in accordance with the method illustrated by flowchart 80 of FIG. 7. Alternatively, the display controller 22 may instead enter the contents of one scanline 58 of one of the framebuffers 20 followed by another scanline 58 of another one of the framebuffers 20, also in accordance with the method illustrated by flowchart 80 of FIG. 7. When the display controller 22 has entered the contents of at least one of the framebuffers 20, the electronic device 10 may check whether any of the framebuffers 20 has been modified as a subsequent frame replaces a prior frame in accordance with a decision block 108. As the electronic device 10 may employ double- or triple-buffering, the electronic device 10 may further check whether the framebuffers 20 holding subsequent frame data hold frame data differing from those of the framebuffers 20 holding corresponding prior frame data.

As shown by the decision block 108, for a given framebuffer 54, if the electronic device 10 does not detect a modification of frame data, the display controller 22 may return to the step 106 to continue to enter the contents of the framebuffer 54 as before. However, if the electronic device 10 does detect a modification of frame data, the electronic device 10 may reset to low each bit of the series of extra bits 74 in each scanline 58 of the framebuffer 54. Once each bit of the series of extra bits 74 has been reset in each scanline 58 of the framebuffer 54, the process returns to the step 106, and the display controller 22 may again enter the contents of the framebuffer in accordance with the method illustrated by the flowchart 80 of FIG. 7.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method of reading a scanline of a framebuffer, comprising:

reading a series of bits from a framebuffer, each bit of the series of bits corresponding to a respective one of a plurality of regions of pixels in a scanline of the framebuffer;

obtaining a stored pixel value for each pixel of a respective region of the scanline by accessing the respective region if a bit corresponding to the respective region is not set; and obtaining a predetermined pixel value for all pixels of the respective region without accessing the respective region if the bit corresponding to the respective region is set.

2. The method of claim 1, wherein the region of pixels has a size of one read burst length.

3. The method of claim 1, wherein the framebuffer is configured to hold pixel data for a frame of one of a plurality of layers.

4. The method of claim 1, wherein the predetermined pixel value is transparent.

5. The method of claim 1, wherein the series of bits is stored at the end of the scanline.

6. The method of claim 1, wherein obtaining the stored pixel value for each pixel of the particular region of the scanline further comprises setting the bit corresponding to the particular region if all pixel values for the pixels of the particular region are of the predetermined pixel value.

7. An electronic device, comprising:

a display;

memory circuitry comprising a framebuffer with a plurality of scanlines, each scanline encoding a row of pixels in a frame, wherein associated with each of the plurality of scanlines is a series of additional bits located within the framebuffer, each bit corresponding to a region in a plurality of regions of pixels in a scanline; and display control circuitry coupled to the memory circuitry and the display, the display control circuitry being configured to prepare pixels for display on the display by setting pixels associated with a region of a scanline to a value obtained from accessing the region if a bit corresponding to the region is not set and setting pixels associated with the region to a preset value without accessing the region if the bit corresponding to the region is set.

8. The electronic device of claim 7, wherein each region of the scanline has a size of one read burst length.

9. The electronic device of claim 7, wherein setting pixels comprises entering pixel data into display control circuitry that is configured to set the bit corresponding to the region if all values obtained from accessing the region are of the preset value.

10. The electronic device of claim 7, wherein the series of additional bits is stored within the scanline with which the series of additional bits is associated.

11. The electronic device of claim 7, wherein the framebuffer is associated with one of a plurality of layers of pixel data.

12. The electronic device of claim 11, wherein the framebuffer is associated with a topmost layer of pixel data.

13. The electronic device of claim 7, wherein the preset value comprises a value representative of a transparent pixel.

14. The electronic device of claim 7, wherein the electronic device comprises at least one of a media player, a portable phone, or a personal data organizer, or any combination thereof.

15. A method of controlling an electronic display, comprising:

fetching from a framebuffer a plurality of bits corresponding to a plurality of regions of pixels in a scanline of the framebuffer; and entering a preset pixel value for all pixels in a region of the plurality of regions of the scanline if a bit of the plurality of bits corresponding to the region is set.

16. The method of claim 15, wherein entering the preset pixel value for all pixels in the region comprises writing the preset pixel value to a buffer.

17. The method of claim 15, comprising fetching and entering a pixel value for each pixel in the region of the scanline if the bit corresponding to the region is not set.

18. The method of claim 17, comprising setting the bit corresponding to the region of the scanline if the pixel value for each pixel in the region is the preset pixel value.

19. The method of claim 17, comprising writing the plurality of bits back to memory.

20. The method of claim 15, wherein the preset pixel value comprises a transparent alpha value for the pixel.

21. A method of displaying a frame of pixels stored in a framebuffer, comprising:

reading from a framebuffer a series of bits, wherein each bit of the series of bits is associated with a respective region of pixels within a series of regions of pixels in a scanline of the framebuffer; and writing pixel data stored in the framebuffer to a first-in-first-out (FIFO) buffer one region at a time, wherein writing pixel data to the FIFO buffer comprises entering a preset pixel value for all pixels in a region of the scanline if a bit corresponding to the region is set and accessing the region to obtain a stored value for each pixel in the region and entering the stored pixel value for each pixel if the bit corresponding to the region is not set.

22. The method of claim 21, wherein the series of regions of pixels in the scanline of the framebuffer is a series of regions of data, each region having a size of one read burst length.

23. The method of claim 22, wherein writing pixel data stored in the framebuffer to the FIFO buffer further comprises setting the bit corresponding to the region if the stored pixel value for each pixel in the region is transparent.

24. The method of claim 21, wherein writing pixel data stored in the framebuffer to the FIFO buffer further comprises setting the bit corresponding to the region if the stored pixel value for each pixel in the region is the same.

25. A method of obtaining data stored in a framebuffer comprising the acts of:

(a) fetching from a framebuffer a plurality of bits corresponding to a plurality of regions of pixels in a scanline of a framebuffer;

(b) entering a preset pixel value for all pixels in a region of the plurality of regions of the scanline if a bit of the plurality of bits corresponding to the region is set;

(c) fetching from memory all pixels in the region of the plurality of regions of the scanline if the bit of the plurality of bits corresponding to the region is not set, and setting the bit of the plurality of bits corresponding to the region if all pixels fetched from the region are of the preset pixel value;

(d) repeating acts (b) and (c) for each region of the plurality of regions until all pixel data from the scanline of the framebuffer has been obtained;

(e) entering the plurality of bits back into memory when all pixel data from the scanline of the framebuffer has been obtained; and (f) repeating acts (a) through (e) until all pixel data from the framebuffer has been obtained.

26. The method of claim 25, comprising the act of (g) resetting all bits of the plurality of bits if the framebuffer is subsequently modified such that each bit of the plurality of bits is not set.

27. The method of claim 25, wherein the preset pixel value indicates that the pixel is transparent.

* * * * *